US012478228B1

(12) United States Patent
Li

(10) Patent No.: US 12,478,228 B1
(45) Date of Patent: Nov. 25, 2025

(54) PORTABLE TOILET SEAT

(71) Applicant: Nanjing JiangDa Trading Co., Ltd., Nanjing (CN)

(72) Inventor: Weidong Li, Quanzhou (CN)

(73) Assignee: Nanjing JiangDa Trading Co., Ltd., Nanjing (CN)

( * ) Notice: Subject to any disclaimer, the term of this patent is extended or adjusted under 35 U.S.C. 154(b) by 0 days.

(21) Appl. No.: 19/272,679

(22) Filed: Jul. 17, 2025

(30) Foreign Application Priority Data

Feb. 19, 2025 (CN) ..... 202520270105.2

(51) Int. Cl.
*A47K 13/00* (2006.01)

(52) U.S. Cl.
CPC ..... *A47K 13/005* (2013.01)

(58) Field of Classification Search
CPC ..... A47K 13/005; A47K 13/06; A47K 13/12; A47K 13/14; A47K 13/16
See application file for complete search history.

(56) References Cited

U.S. PATENT DOCUMENTS

2012/0042443 A1* 2/2012 Aguila ..... A47K 13/06 4/245.6

FOREIGN PATENT DOCUMENTS

| | | | | | |
|---|---|---|---|---|---|
| CN | 102058343 | A | * | 5/2011 | ..... A47K 13/12 |
| CN | 203987827 | U | | 12/2014 | |
| CN | 104367264 | A | | 2/2015 | |
| CN | 212394771 | U | | 1/2021 | |
| KR | 900003855 | Y1 | * | 5/1990 | ..... A47K 13/06 |
| KR | 20100068610 | A | * | 6/2010 | ..... A47K 13/06 |

* cited by examiner

*Primary Examiner* — Tuan N Nguyen
(74) *Attorney, Agent, or Firm* — Nitin Kaushik

(57) ABSTRACT

A portable toilet seat is provided, including an upper seat cushion plate. One side of the upper seat cushion plate is rotatably connected to a lower seat cushion plate, a retractable rectangular bushing is arranged on the upper seat cushion plate, a limiting fastening plate is arranged at a central position of an upper surface of the retractable rectangular bushing, a telescopic plate is movably connected inside the retractable rectangular bushing, a joining plate is fixedly connected to one end of the telescopic plate that is away from the upper seat cushion plate, a fixing plate is fixedly connected to one end of the joining plate that is away from the telescopic plate, and suction cups are symmetrically disposed on a back side of the fixing plate. A folding function is achieved by a rotating connection of the upper seat cushion plate and the lower seat cushion plate.

5 Claims, 1 Drawing Sheet

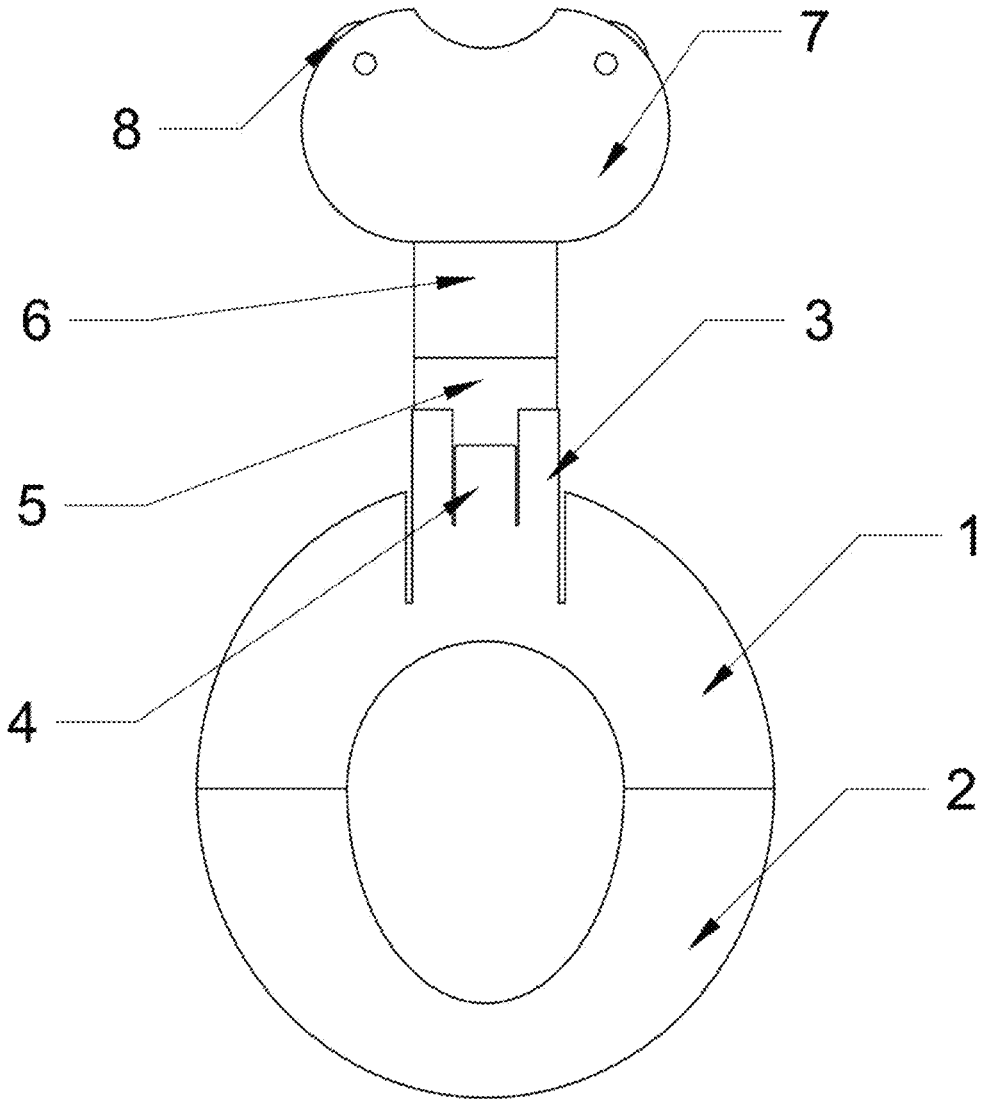
7
8
6
3
5
1
4
2

PORTABLE TOILET SEAT

CROSS-REFERENCE TO RELATED APPLICATIONS

The application claims priority to Chinese patent application No. 202520270105.2, filed on Feb. 19, 2025, the entire contents of which are incorporated herein by reference.

TECHNICAL FIELD

The present disclosure relates to the technical field of toilets, and in particular, to a portable toilet seat.

BACKGROUND

A toilet is a toilet seat, a sanitary appliance, a sanitary device used for excretion, and usually made of ceramics or plastics. The main body of the toilet usually includes a seat and a flusher.

Existing toilet seats are mainly designed for adults and conform to the size for adults. For children, the toilet seat is too large and is not suitable for them. When children are undergoing toilet training at home or using the toilet outside, they feel uncomfortable using the existing toilet seat and cannot sit or stand on their own.

SUMMARY

An objective of the present disclosure is to provide a portable toilet seat, to solve the problems proposed in the above background.

To achieve the above objective, the present disclosure provides the following technical solutions: a portable toilet seat, including an upper seat cushion plate, where one side of the upper seat cushion plate is rotatably connected to a lower seat cushion plate, a retractable rectangular bushing is arranged on the upper seat cushion plate, a limiting fastening plate is arranged at a central position of an upper surface of the retractable rectangular bushing, a telescopic plate is movably connected inside the retractable rectangular bushing, a joining plate is fixedly connected to one end of the telescopic plate that is away from the upper seat cushion plate, a fixing plate is fixedly connected to one end of the joining plate that is away from the telescopic plate, and suction cups are symmetrically disposed on a back side of the fixing plate.

Preferably, the upper seat cushion plate is connected to the lower seat cushion plate by a pin, a combined center of the upper seat cushion plate and the lower seat cushion plate forms an excretion circle, and a urine stopper is arranged at one end of the lower seat cushion plate that is located on the excretion circle.

Preferably, the upper seat cushion plate, the retractable rectangular bushing and the limiting fastening plate are an integrated structure, and the limiting fastening plate is inclined to one side of the telescopic plate.

Preferably, a plurality of indentations are arranged at a position where the telescopic plate corresponds to the limiting fastening plate.

Preferably, a limiting block is arranged at one end of the telescopic plate that is close to the upper seat cushion plate.

Compared with the existing technology, the present disclosure has the following beneficial effects: a folding function is achieved by a rotating connection of the upper seat cushion plate and the lower seat cushion plate, so the portable toilet seat is easy to carry. The size of the seat can be adjusted by using the retractable rectangular bushing and the telescopic plate, so the seat is suitable for children and allows children to sit and use alone. The suction cups are conveniently and quickly mounted due to being directly attached to the toilet

BRIEF DESCRIPTION OF DRAWINGS

The FIGURE is a schematic diagram of an overall structure according to the present disclosure.

In the FIGURE: upper seat cushion plate 1; lower seat cushion plate 2; retractable rectangular bushing 3; limiting fastening plate 4; telescopic plate 5; joining plate 6; fixing plate 7; suction cup 8.

DETAILED DESCRIPTION OF THE EMBODIMENTS

The technical solutions in the embodiments of the present disclosure will be described clearly and completely below in conjunction with the drawings in the embodiments of the present disclosure. Based on the embodiments of the present disclosure, all other embodiments obtained by those of ordinary skill in the art without contributing creative work shall fall within the scope of protection of the present disclosure.

Referring to the FIGURE, a portable toilet seat provided by one embodiment of the present disclosure includes an upper seat cushion plate 1. One side of the upper seat cushion plate 1 is rotatably connected to a lower seat cushion plate 2, a retractable rectangular bushing 3 is arranged on the upper seat cushion plate 1, a limiting fastening plate 4 is arranged at a central position of an upper surface of the retractable rectangular bushing 3, a telescopic plate 5 is movably connected inside the retractable rectangular bushing 3, a joining plate 6 is fixedly connected to one end of the telescopic plate 5 that is away from the upper seat cushion plate 1, a fixing plate 7 is fixedly connected to one end of the joining plate 6 that is a way from the telescopic plate 5, and suction cups 8 are symmetrically disposed on a back side of the fixing plate 7. The suction cups 8 are adsorbed on the toilet, and then the telescopic plate 5 is extended to make the lower seat cushion plate 2 be in contact with the other side of the toilet, to achieve position fixation, and the telescopic plate 5 can be adjusted according to the size of the toilet, has high applicability, and is convenient and quick to mount.

The upper seat cushion plate 1 is connected to the lower seat cushion plate 2 by a pin, and the relative fixation and folding of the upper seat cushion plate 1 and the lower seat cushion plate 2 are achieved by the damping of the pin connection. A combined center of the upper seat cushion plate 1 and the lower seat cushion plate 2 forms an excretion circle, and a urine stopper is arranged at one end of the lower seat cushion plate 2 that is located on the excretion circle. The urine stopper is a structure that is higher than the excretion circle and belongs to a part of the excretion circle.

The upper seat cushion plate 1, the retractable rectangular bushing 3 and the limiting fastening plate 4 are an integrated structure, which is more convenient and quicker to manufacture and produce. The limiting fastening plate 4 is inclined to one side of the telescopic plate 5, and the telescopic plate 5 is fastened by the inclined extrusion of the limiting fastening plate 4.

A plurality of indentations are arranged at a position where the telescopic plate 5 corresponds to the limiting fastening plate 4, to improve the fastening effect and provide higher overall stability. A limiting block is arranged at one end of the telescopic plate 5 that is close to the upper seat cushion plate 1, to prevent the telescopic plate 5 from separating from the upper seat cushion plate 1.

Working principles: when in use, the lower seat cushion plate 2 is rotated such that the upper seat cushion plate 1 and the lower seat cushion plate 2 form the excretion circle, the suction cups 8 are adsorbed on the toilet, the telescopic plate 5 is extended such that the lower seat cushion plate 2 is in contact with the other side of the toilet, to achieve the position fixation, with convenient and quick mounting, and convenient use.

What is claimed is:

1. A portable toilet seat, comprising an upper seat cushion plate (1), wherein one side of the upper seat cushion plate (1) is rotatably connected to a lower seat cushion plate (2), a retractable rectangular bushing (3) is arranged on the upper seat cushion plate (1), a limiting fastening plate (4) is arranged at a central position of an upper surface of the retractable rectangular bushing (3), a telescopic plate (5) is movably connected inside the retractable rectangular bushing (3), a joining plate (6) is fixedly connected to one end of the telescopic plate (5) that is away from the upper seat cushion plate (1), a fixing plate (7) is fixedly connected to one end of the joining plate (6) that is away from the telescopic plate (5), and suction cups (8) are symmetrically disposed on a back side of the fixing plate (7).

2. The portable toilet seat according to claim 1, wherein the upper seat cushion plate (1) is connected to the lower seat cushion plate (2) by a pin, a combined center of the upper seat cushion plate (1) and the lower seat cushion plate (2) forms an excretion circle, and a urine stopper is arranged at one end of the lower seat cushion plate (2) that is located on the excretion circle.

3. The portable toilet seat according to claim 1, wherein the upper seat cushion plate (1), the retractable rectangular bushing (3) and the limiting fastening plate (4) are an integrated structure, and the limiting fastening plate (4) is inclined to one side of the telescopic plate (5).

4. The portable toilet seat according to claim 1, wherein a plurality of indentations are arranged at a position where the telescopic plate (5) corresponds to the limiting fastening plate (4).

5. The portable toilet seat according to claim 1, wherein a limiting block is arranged at one end of the telescopic plate (5) that is close to the upper seat cushion plate (1).

* * * * *